US008403048B2

(12) United States Patent
Laird et al.

(10) Patent No.: US 8,403,048 B2
(45) Date of Patent: Mar. 26, 2013

(54) SLICKLINE RUN HYDRAULIC MOTOR DRIVEN TUBING CUTTER

(75) Inventors: Mary L. Laird, Madisonville, LA (US); Robbie B. Colbert, Perdido, AL (US)

(73) Assignee: Baker Hughes Incorporated, Houston, TX (US)

( * ) Notice: Subject to any disclaimer, the term of this patent is extended or adjusted under 35 U.S.C. 154(b) by 241 days.

(21) Appl. No.: 12/795,292

(22) Filed: Jun. 7, 2010

(65) Prior Publication Data

US 2011/0297379 A1 Dec. 8, 2011

(51) Int. Cl.
*E21B 29/00* (2006.01)

(52) U.S. Cl. ..... 166/298; 166/55.7

(58) Field of Classification Search ..... 166/297, 166/298, 55.7, 55.8
See application file for complete search history.

(56) References Cited

U.S. PATENT DOCUMENTS

| | | | | |
|---|---|---|---|---|
| 2,280,769 | A * | 4/1942 | Page | 451/465 |
| 3,396,795 | A * | 8/1968 | Venghiattis | 166/55.7 |
| 3,920,070 | A * | 11/1975 | Goins | 166/55.8 |
| 5,992,289 | A | 11/1999 | George et al. | |
| 7,086,467 | B2 | 8/2006 | Schlegelmilch et al. | |
| 7,225,873 | B2 | 6/2007 | Schlegelmilch et al. | |
| 7,370,703 | B2 | 5/2008 | Hill et al. | |
| 7,478,982 | B2 | 1/2009 | Fuhst et al. | |
| 7,546,876 | B2 * | 6/2009 | McAfee | 166/298 |
| 7,575,056 | B2 | 8/2009 | Fuhst et al. | |
| 7,802,949 | B2 * | 9/2010 | Fuhst et al. | 409/143 |
| 8,151,902 | B2 | 4/2012 | Lynde et al. | |
| 8,210,251 | B2 | 7/2012 | Lynde et al. | |
| 2003/0066650 | A1 | 4/2003 | Fontana et al. | |
| 2004/0163808 | A1 | 8/2004 | Ringgenberg et al. | |
| 2010/0089583 | A1 | 4/2010 | Xu et al. | |

FOREIGN PATENT DOCUMENTS

EP 0481767 10/1991

OTHER PUBLICATIONS

Flett, C., et al., "The Application of Heavy Duty Wireline Fishing Techniques Retrieves Wellbore Obstruction and Allows Well to be Plugged and Full Integrity to be Retained", SPE 143240, Apr. 2011, 1-8.

Foster, Jerry, et al., "Slickline-Deployed Electro-Mechanical Intervention System, a Cost-Effective Alternative to Traditional Cased-Hole Services", SPE 67201, Mar. 2001, 1-14.

Foster, Jerry, et al., "Slickline-Deployed Electro-Mechanical Intervention System: A Cost-Effective Alternative to Traditional Cased-Hole Services", SPE 70031, May 2001, 1-15.

* cited by examiner

*Primary Examiner* — William P Neuder
(74) *Attorney, Agent, or Firm* — Steve Rosenblatt

(57) ABSTRACT

A tubing cutter is run in with a bottom hole assembly that includes a seal and support within the tubing to be cut. A ported sub allows pressurized fluid pumped from the surface to enter the bottom hole assembly above the sealed support location and to be directed to set an anchor and to a fluid driven motor such as a progressive cavity motor that is in turn connected to the tubing cutter at the rotor of the progressive cavity motor. The rotation of the cutter with its blades extended cuts the tubular as the fluid exiting the stator goes to the lower end of the tubing being cut and can return to the surface through an annulus around the tubing to be cut. Other configurations such as cutting casing or cutting casing through tubing are also envisioned.

22 Claims, 1 Drawing Sheet

SLICKLINE RUN HYDRAULIC MOTOR DRIVEN TUBING CUTTER

FIELD OF THE INVENTION

The field of this invention is tubular cutters and more specifically those that are rotatably driven by a bottom hole assembly suspended from the surface with a cable while a motor in the assembly powers the cutter using fluid flow into the tubular.

BACKGROUND OF THE INVENTION

Tubing cutters have been run into a subterranean location into tubing that is to be cut on coiled tubing and/or tubular. The coiled tubing or tubular has fluid pumped through it to power a downhole motor that is fluid driven such as a progressing cavity pump. The rotation of the pump drives the cutter after extending its blades. Some examples are U.S. Pat. Nos. 7,225,873 and 7,086,467. Coiled tubing units are frequently not at a well site and are very expensive to deploy.

Older designs would cut tubing using explosive charges that are set off with a dropped weight on a slickline such as illustrated in U.S. Pat. No. 5,992,289. These tools did not rotate and the positioning of the explosives made the circumferential cut. These designs had the obvious safety issues of dealing with explosives. The extension reach of the explosion could damage the outer string on the back side of the tubing being cut.

Rotating tubing cutters have been run in on wireline where power was transmitted to an electric motor in the bottom hole assembly as illustrated in U.S. Pat. No. 7,370,703.

Other assemblies disclose the use of a tubing cutter but the focus is on how the blades are extended or how the cutter is anchored with no details about the drive system other than stating that there is a driver and that the traditional conveyances for cutters such as coiled tubing, wireline or slickline can be used. Some examples are U.S. Pat. Nos. 7,478,982 and 7,575,056.

There are many occasions where a coiled tubing unit or an E-line rig is not available and a need to cut tubing arises. Under those circumstances it would be advantageous to use a slickline supported cutter. Since a slickline cannot convey power and a self contained power supply in the bottom hole assembly, such as a battery, may not have the output to get the job done or may not even fit in a confined location of a small wellbore, the present invention provides an alternative to make the tubing cut.

The preferred deployment of the invention is in a well with production tubing inside casing where the tubing is cut to be freed from a production packer by allowing it to extend so that its slips and sealing system can retract. In the context of this application, the reference to "tubing" is to tubular strings in a wellbore and includes casing, production or injection tubing in casing or tubulars in other environments that need to be cut. In the preferred mode the rig pumps provide fluid under pressure around the bottom hole assembly that is supported in the tubular to be cut in a sealed manner and retained against reaction torque from the cutting operation. The pumped fluid enters the bottom hole assembly through a ported sub and goes to a fluid driven pump such a progressing cavity pump to operate the cutter. Exhaust fluid from the pump goes out the tubing and back to the surface through perforated holes in the tubing allowing access to the annulus where the tubing inside the casing is being cut. Those skilled in the art will more readily appreciate other aspects of the invention from a review of the detailed description and the associated drawings that appear below while recognizing that the full scope of the invention is to be found in the appended claims.

SUMMARY OF THE INVENTION

A tubing cutter is run in with a bottom hole assembly that includes a seal and support within the tubing to be cut. A ported sub allows pressurized fluid pumped from the surface to enter the bottom hole assembly above the sealed support location and to be directed to set an anchor and to a fluid driven motor such as a progressive cavity motor that is in turn connected to the tubing cutter at the rotor of the progressive cavity motor. The rotation of the cutter with its blades extended cuts the tubular as the fluid exiting the stator goes to the lower end of the tubing being cut and can return to the surface through an annulus around the tubing to be cut. Other configurations such as cutting casing or cutting casing through tubing are also envisioned.

DETAILED DESCRIPTION OF THE PREFERRED EMBODIMENT

Figure 1A:
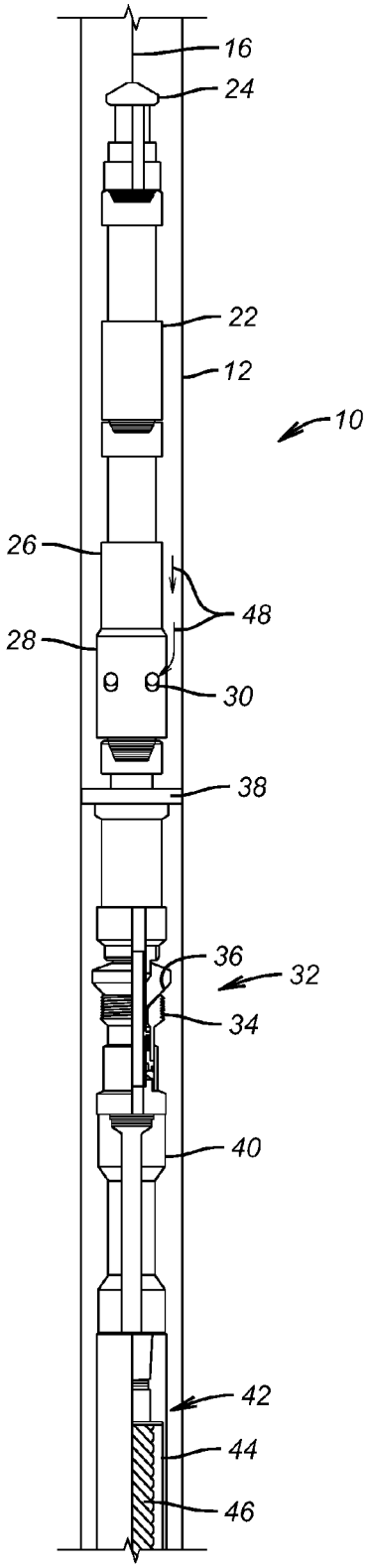
FIGS. 1*a*-1*b* show the arrangement of a bottom hole assembly with the tubing to be cut omitted for clarity.
Figure 1B:
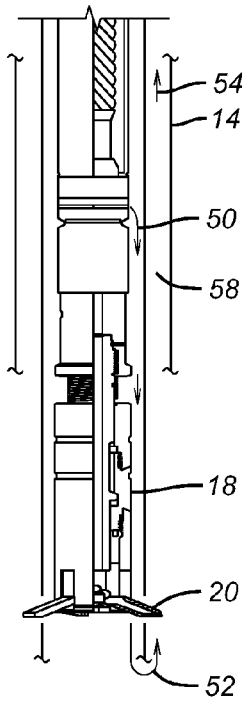

The cutter assembly 10 is preferably positioned in a tubular string 12 that is disposed in a surrounding string such as casing 14 shown in part in FIG. 1*a*. A slickline 16 or alternatively a wireline, if available at the surface, supports the illustrated equipment down to the cutter 18 shown in FIG. 1*a* with cutting blades 20 extended into the cutting position. The slickline 16 supports an optional accelerator 22 for use in shallow depth applications. Other familiar components when running slickline are employed in the assembly 10 such as a fishing neck 24 and a jar tool such as 26. The jar tool 26 allows jarring to get unstuck while the fishing neck 24 allows the assembly to be fished out if the jar tool 26 does not help it break loose. A ported sub 28 has ports 30 that preferably stay open.

The equipment shown below the ported sub 28 is schematically illustrated to perform a sealing function in string 12 so that fluid pumped from the surface will go into ports 30 and for securing the bottom hole assembly against reaction torque from the cutting operation as the blades 20 are rotated. The anchor tool 32 has slips 34 driven along ramps 36 to bite the inside of the string 12 for support of the weight of the assembly 10 and to retain the assembly 10 against rotation. A seal 38 is radially extendable in a variety of ways. It can be made of a swelling material that reacts to well fluids or added fluids to swell and seal. It can be set against the inner wall of the string 12 by longitudinal compression that is initiated mechanically such as when a slickline 16 is in use or it can be actuated electrically using a setting tool powered by power delivered through a wireline, when available. If the string 12 has a landing nipple that has a seal bore, on the other hand, the seal 38 can just be advanced into the seal bore to get a seal. The no-go that is typically provided in a landing nipple can be configured not only for weight support but also for a rotational lock of the assembly 10. In those cases with latching into a landing nipple the anchor 32 would not be used as dogs going into a profile provide weight support and a rotational lock.

One or more pipe sections 40 can be provided for proper spacing of the blades 20 when working off a landing nipple. When using an anchor 32 that can be deployed as needed, the pipe sections 40 can be eliminated. A downhole motor 42, preferably a progressive cavity Moineau pump is used with a stationary stator 44 and a rotor 46 operatively connected to the tubing cutter 18. Arrows 48 represent pumped fluid from the surface going down the string 12 and entering the ports 30. From there the flow continues within the assembly 10 to the stator 44 which sets the rotor 46 turning. The fluid is exhausted from the stator 46 and follows the path of arrows 50, 52 and 54 to get back to the surface through the annulus 58 between strings 12 and 14.

When used in a cased hole to cut casing the exhaust fluid from the motor 42 can be directed further downhole such as into a formation, although in some application this may not be desirable. With larger sizes there can also be issues of the weight capacity of the slickline to support the assembly 10. The preferred application is in cutting production or injection tubing such as in applications to sever a packer body to allow it to be released so that it can be removed with the tubing being severed. The anchor and seal 32 and 38 can be configured for multiple deployments at different locations in a single trip so that more than one cut of the tubular 12 can take place in one trip. Various configurations of rotating cutters are envisioned that are responsive to rotational input to operate. The tubing cutter 18 is a known product adapted to be used in the assembly 10.

In a broad sense a bottom hole assembly 10 can be run in on a cable, whether slickline or a wireline, if available, for support in a tubular to be cut and the ability to divert flow pumped into the tubular to a downhole motor to make the cut with a rotary bladed cutter or in the alternative with a fluid jet or jets that can cut through the tubing either with or without body rotation of the cutter. The motor 42 can drive a downhole pump that builds pressure that is exhausted through jet nozzles in the cutter 18. Alternatively the tubing 12 above the seal 38 can be raised to a high enough pressure to operate cutting jets in the cutter 18. The support cable can be selectively released to be removed from the wellbore after the tubular is cut. Depending on the cutter configuration the tubing can be cut circumferentially for 360 degrees to remove a part of it or an opening of a desired shape can also be cut into the tubular 12 depending on the cutter configuration.

The above description is illustrative of the preferred embodiment and many modifications may be made by those skilled in the art without departing from the invention whose scope is to be determined from the literal and equivalent scope of the claims below.

We claim:

1. A method of cutting a tubular in a borehole leading to a subterranean location, comprising:
delivering a tubular cutter assembly at least in part on a cable within a tubular to be cut;
pumping fluid into the tubular to be cut—to pressurize at least a portion of said tubular to be cut and to use said pressure as the driving force for said cutter;
cutting the tubular with said cutter.

2. The method of claim 1, comprising:
driving a motor operably connected to said cutter with said pumping.

3. The method of claim 2, comprising:
diverting said pumped fluid to said motor.

4. The method of claim 3, comprising:
using a progressing cavity device as said motor.

5. The method of claim 3, comprising:
directing fluid exhausted from said motor to the surface.

6. The method of claim 1, comprising:
using a slickline or a wireline as said cable.

7. The method of claim 1, comprising:
driving said pumped fluid through fluid nozzles on said cutter.

8. The method of claim 1, comprising:
using pressure in said tubular to advance said cutter toward a cut location in said tubular to be cut.

9. A method of cutting a tubular, comprising:
supporting a tubular cutter assembly at least in part on a cable within a tubular to be cut;
pumping fluid into the tubular to be cut to operate said cutter;
cutting the tubular with said cutter;
a motor operably connected to said cutter with said pumping;
diverting said pumped fluid to said motor;
directing fluid exhausted from said motor to the surface;
flowing said exhausted fluid out of a lower end of said tubular to be cut and back to the surface through an annular space defined between said tubular to be cut and a surrounding tubular.

10. A method of cutting a tubular, comprising:
supporting a tubular cutter assembly at least in part on a cable within a tubular to be cut;
pumping fluid into the tubular to be cut to operate said cutter;
cutting the tubular with said cutter;
a motor operably connected to said cutter with said pumping;
diverting said pumped fluid to said motor;
accomplishing said diverting with an exterior seal on said assembly.

11. The method of claim 10, comprising:
actuating said seal to engage an inner surface of the tubular to be cut.

12. The method of claim 10, comprising:
providing a seal bore in the tubular to be cut; and
inserting said seal into said seal bore to accomplish said diverting.

13. The method of claim 10, comprising:
providing a ported sub adjacent said seal; and
directing flow through said ported sub and into said motor.

14. The method of claim 13, comprising:
providing a hydraulically actuated anchor in said assembly.

15. The method of claim 14, comprising:
locating said anchor between said seal and said motor;
using said diverted fluid to actuate both said anchor and said motor.

16. The method of claim 13, comprising:
supporting said assembly on a landing nipple in said tubular to be cut.

17. The method of claim 13, comprising:
using rotation of the motor to drive at least one blade on said cutter in contact with said tubular to be cut.

18. The method of claim 17, comprising:
cutting a 360 degree cut on the tubular to be cut.

19. The method of claim 17, comprising:
cutting an opening in the tubular to be cut.

20. The method of claim 17, comprising:
using a slickline as said cable.

21. The method of claim 13, comprising:
driving a pump with said motor;
boosting pressure of fluid in said tubular to be cut with said pump;
directing fluid from said pump through at least one jet nozzle in said cutter.

22. The method of claim 10, comprising:
using developed pressure on said seal to advance said cutter to a cut location on said tubular to be cut.

* * * * *